United States Patent [19]

Yaghmaie et al.

[11] Patent Number: 4,749,381

[45] Date of Patent: Jun. 7, 1988

[54] STABLE SLURRIES OF SOLID CARBONACEOUS FUEL AND WATER

[75] Inventors: Farrokh Yaghmaie, Hopewell Junction; Ronald J. McKeon, Beacon, both of N.Y.

[73] Assignee: Texaco Inc., White Plains, N.Y.

[21] Appl. No.: 674,804

[22] Filed: Nov. 26, 1984

[51] Int. Cl.[4] ..... C10L 1/32

[52] U.S. Cl. ..... 44/51

[58] Field of Search ..... 44/51; 48/DIG. 7, 202, 48/197 R

[56] References Cited

U.S. PATENT DOCUMENTS

| | | | |
|---|---|---|---|
| 4,094,810 | 6/1978 | Thomas | 44/51 |
| 4,104,035 | 8/1978 | Cole et al. | 44/51 |
| 4,315,755 | 2/1982 | Hellsten et al. | 44/51 |
| 4,406,663 | 9/1983 | Baldwin | 44/51 |
| 4,478,603 | 10/1984 | Mark | 44/51 |

*Primary Examiner*—William R. Dixon, Jr.
*Assistant Examiner*—Margaret B. Medley
*Attorney, Agent, or Firm*—Robert A. Kulason; James J. O'Loughlin; Albert Brent

[57] ABSTRACT

A pumpable slurry of solid carbonaceous fuel and water with reduced viscosity and increased resistance to sedimentation comprising about 50 to 75 weight percent of comminuted solid carbonaceous fuel having less than 10.0 weight percent of combined oxygen, about 0.1 to 10.0 weight percent of a surfactant comprising an anionic or nonionic adduct of a mono or dialkyl phenol and polyoxyethylene or polyoxypropylene, and the remainder of the slurry is water.

2 Claims, No Drawings

STABLE SLURRIES OF SOLID CARBONACEOUS FUEL AND WATER

FIELD OF THE INVENTION

This invention relates to stable aqueous slurries of solid carbonaceous fuel which are suitable for gasifying by the partial oxidation process. More particularly, it pertains to a novel pumpable stabilized slurry of solid carbonaceous fuel having less than 10 weight percent of combined oxygen and water with reduced viscosity and sedimentation rate.

Solid carbonaceous fuels such as coal, petroleum coke, shale, asphalt, etc. have been dispersed in liquid mediums such as water and liquid hydrocarbons to form pumpable slurries. These slurries have been introduced as feedstock into partial oxidation gas generators in processes disclosed for example in coassigned U.S. Pat. Nos. 3,544,291; 3,620,698; 4,104,035; 4,265,407; and 4,328,008.

Various additives for dispersing coal in water are described in coassigned U.S. Pat. No. 4,104,035 and also in U.S. Pat. No. 4,358,293. However, the slurry compositions described therein differ from the novel slurry compositions of the subject invention which are specific for medium to high rank solid carbonaceous fuel. The hydrophobicity of solid carbonaceous fuels increases with rank. The amount of combined oxygen in solid carbonaceous fuel decreases with increasing rank. Accordingly, by limiting the weight percent of combined oxygen to a maximum of 10 weight percent, the subject process is limited to medium to high rank solid carbonaceous fuels which ordinarily have high sedimentation rates. Unexpectedly and advantageously, the slurry compositions of the subject invention have reduced sedimentation rates as well as reduced viscosities in comparison with conventional slurries.

SUMMARY OF THE INVENTION

In accordance with the invention there is provided a pumpable slurry of solid carbonaceous fuel and water with reduced viscosity and increased resistance to sedimentation in comparison with the same slurry but without any surfactant. The slurry comprises about 50 to 75 weight percent of comminuted solid carbonaceous fuel having less than 10.0 weight percent of organically combined oxygen, about 0.1 to 10.0 weight percent (basis weight of solid fuel) of a surfactant comprising an anionic or nonionic adduct of mono or dialkyl phenol and polyoxyethylene or polyoxypropylene, said surfactant having structural Formula I, as follows:

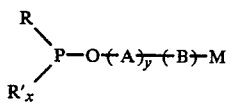

I wherein:

R and R′ are the same or different alkyl groups with 9 to 24 carbon atoms and x equals 0 or 1; P—O— is a phenolic moiety in which O is oxygen, A is an ethoxy or propoxy group and y equals 5 to 19 when x is 0 and 4 to 19 when x is 1; B is $-(CH_2-CH_2)-$ when A is ethoxy; or either

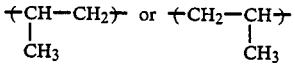

when A is propoxy; and M is the terminating moiety and is selected from the group consisting of —OH, $-SO_3Na^+$, and $-O-SO_3Na^+$; and the balance of said slurry is water.

DISCLOSURE OF THE INVENTION

The subject invention deals with stable pumpable slurries of medium to high rank solid carbonaceous fuel and water. While these slurry compositions have a high solids content, e.g. 50 to 70 weight percent, they are pumpable and have a low viscosity and reduced sedimentation rate in comparison with other solid fuel and water slurries with the same solid content. The suspension of coal particles in water is desired for transportation and processing. Fast sedimentation of coal particles can cause operational difficulties.

The excellent pumpability of the subject slurries permits them to be transported long distances by pipeline without the solids settling out. The slurries make excellent fuels for boilers and improved feedstocks for the partial oxidation process. For example, in coassigned U.S. Pat. No. 3,544,291, which is incorporated herein by reference, aqueous slurries of solid carbonaceous fuel are reacted with a free oxygen containing gas by partial oxidation to produce synthesis gas, reducing gas, and fuel gas.

To maintain a high combustion efficiency and to reduce oxygen consumption in the partial oxidation process, it is necessary for the slurry feed to be uniform and the solids content to be high. When excess water is present in the feed slurry, valuable energy, e.g. heat, is lost in vaporizing the water and less solid carbonaceous fuel is converted into synthesis gas. For maximum combustion efficiency, the solid fuel particles must be highly dispersed in a limited amount of the water carrier. Since the hydrophobicity of medium to high rank solid fuels is high, but for the subject invention particles of these solid fuels would settle out rapidly from quiescent aqueous dispersion thereby reducing the combustion efficiency. By adding the subject surfactant to slurries of solid carbonaceous fuel and water, it was unexpectedly found that not only is there a substantially increased resistance to sedimentation of the solid fuel particles but the solids content of the slurry may be increased 25 wt. % or more while the viscosity may be substantially reduced to provide a greatly improved pumpable slurry of solid fuel. No other additives are required.

By definition, medium or high rank solid carbonaceous fuel has less than 10.0 weight percent of organically combined oxygen. Such solid carbonaceous fuels may be selected from the group consisting of anthracite coal, petroleum coke, coal liquefaction solid residue, asphaltic bitumen, and mixtures thereof. High rank coal comprising 5.0 wt. % or below of organically combined oxygen is preferred.

The moisture content of the solid carbonaceous fuel particles is in the range of about 0 to 25 wt. %, such as about 0.5 to 10 wt. %. Predrying may be required in some instances to reach these levels. Any suitable grinding system may be used to convert the solid carbonaceous fuels or mixtures thereof to the proper size.

The comminuted solid carbonaceous fuel has a particle size of less than ASTM E-11 Alternate Sieve Designation No. 14 e.g. 1400 microns. In one embodiment, the solid carbonaceous fuels are preferably ground to a particle size so that 99.9 wt. % of the material passes through an ASTM E11 Sieve Designation Standard 1.40 mm (Alternative No. 14), 99.5 wt. % of the material passes through an ASTM E11 Sieve Designation Standard 425 μm (Alternative No. 40), and at least 50 wt. % of the material passes through an ASTM E11 Sieve Designation Standard 45 μm (Alternative No. 325). 1000 μm=1 mm.

Any suitable conventional ball or rod mill may be used to grind the raw solid fuel to the desired particle size. Preferably, the solid fuel is wet ground with water so that a ground slurry product is produced having the right solids concentration. Preferably, about 0.1 to 10.0 wt. % (basis weight of solid fuel) of the surfactant is added during the wet grinding stage. Alternatively, the solid fuel is ground dry and then mixed with water and surfactant. Optionally, the surfactant may be added while the solid fuel water slurry is being held in a holding tank.

The surfactant comprises an anionic or nonionic adduct of mono or dialkyl phenol and polyoxyethylene or polyoxylpropylene having structural Formula I, as follows:

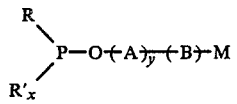

I wherein:

R and R' are the same or different alkyl groups with 9 to 24 carbon atoms and x equals 0 or 1; P—O— is a phenolic moiety in which O is oxygen, A is an ethoxy or propoxy group and y equals 5 to 19 when x is o e.g. monoalkylphenol and 4 to 19 when x is 1 e.g. dialkylphenol; B is $-(CH_2-CH_2)-$ when A is ethoxy; or either

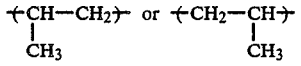

when A is propoxy; and M is the terminating moiety and is selected from the group consisting of —OH, $-SO_3Na^+$, and $-O-SO_3Na^+$; and the balance of said slurry is water.

It is suggested that the aforesaid surfactant is adsorbed on the surface of the solid fuel particles, such as coal. Coal is a heterogenous system and a combination of adsorption schemes may give a more complete representation of surfactant adsorption. The organic matter of coal (macerals) contains mostly carbon and hydrogen. The oxygen functional groups (such as phenol and carboxylic acids) form the polar groups. The inorganic matter is intermixed with organic matter and consists mostly of clay material. The clay structure (silica-alumina) shows Lewis and Bronsted acidity. The presence of empty orbitals in alumina as electron acceptors is responsible for the Lewis acidity. The hydroxy groups of silica may add to its Bronsted acidity. Based upon these, two modes of adsorption may be proposed. Mode A pictures the non-ionogenic groups being adsorbed on the coal surface. Mode B, postulates adsorption of surfactants by the polar groups or groups capable of donating electrons or participating in hydrogen bonding.

The subject surfactants comprise a series of oxyethylene or oxypropylene oligomers with nonionic or anionic terminating groups. These surfactants are products of nonyl phenol polymerization with ethylene or propylene oxides. By controlling the molar ratios of the oxide(s) to the phenol, oligomers of various sizes are obtained. These materials are terminated with a nonionic or an anionic group e.g. sulfate or sulfonate. It was unexpectedly found that the number of repeating units is critical. y in Formula I must be at least 5 when x is 0 (for monoalkylphenols) in order to avoid a thick slurry. A gradual decrease in viscosity of the slurries was observed when y is 5 to 19 and x is 0. However, when x is 1 (for diaklyl phenols), pumpable slurries are obtained when y is in the range of 4 to 19. The lowest viscosity was obtained when higher molecular weight materials were used. The theoretical molecular weight of these surfactants are in the range of about 484 to 1100. They are water soluble or at least water dispersible. No co-surfactant is required. Further, they are comparatively low in cost. Also, the subject surfactants drastically increase the dispersion of the coal particles.

The solubility of the nonionic surfactants decreases with temperature. As the number of repeating units increases, the solubility (in water) increases. This can be explained in terms of hydrogen bonding association of ether groups with water. In principle as the number of the repeating groups increases, the number of water molecules associating with a given chain increases, which in turn increases its solubility. With nonionic surfactants, the molecular weight of the polymer appears to be the controlling factor.

The adsorption mode of the nonionic oligomer, based upon the chemistry of clay material can be explained. Since upon the chemistry of clay material can be explained. Since clay minerals (as most of the macerals are) contain Bronsted and Lewis acidity, the ether linkage may compete for adsorption better than the phenyl group. The oxygen can participate on hydrogen bonding with coal surfaces or it can donate electron pairs to empty orbitals of alumina. As the number of the repeating units increases, the chances of adsorption of oxyethylene chain increases. This leads to formation of a protective layer. In this case due to absence of an ionogenic group, the protective (adsorbed) layer is not charged. This constitutes a major difference with lignin sulfonates reported in the past. Nonionic surfactants are capable of reducing the viscosity of coal-water slurries. As a result the alteration of the coal surface properties is not expected to be due to the electrical properties of the surfactants. The surfactants are probably adsorbed via their ether linkages. The dispersion and viscosity-reducing properties of these surfactants are related to their chain length. There appears to be an optimum size which provides the desirable results.

With respect to the oligomers terminated with anionic polar groups, the molecular weight of the surfactant is not a controlling factor. Instead sulfate or sulfonate groups contribute to the overall process. The polar groups enhance the potential of low molecular weight oligomers as viscosity reducing agents. The oligomeric surfactants with a strong anionic terminating group have better viscosity reducing properties than the nonionic surfactants with comparable chain length without an anionic group. From a practical point of view, the subject surfactants with a nonionic or anionic group are improved and superior surfactants for coal water slurries.

The following examples illustrate the subject invention and should not be construed as limiting the scope of the invention.

EXAMPLES

Coal-water slurries having a solids concentration in the range of about 62 to 65 wt. % were prepared from high rank anthracite coal comprising 5.0 wt. % organically combined oxygen and having a particle size of ASTM E-11 Sieve Designation Alternate No. 60 (250 microns). A series of surfactants comprising the anionic or nonionic adducts of mono or dialkyl phenol and polyoxyethylene or polyoxypropylene and having structural Formula I, as previously described are mixed with the coal-water slurry in the amount of 1.0 wt. % (basis weight of solids). The following Formula I surfactants A to G are described in Table I. These surfactants were added to the coal-water slurry in the amount specified and reduced the viscosity of the coal-water slurry and decreased the sedimentation rate, in the manner shown in Tables II and III respectively.

The viscosities of the coal-water slurries in Table II are determined by a rotational viscometer at the five shear rates shown in Table II. In general, there is a substantial reduction in viscosity when a small amount of the specified surfactant is mixed with the slurry. Further, the viscosity of of the slurry falls off as the number of oxypolyalkylene groups or the molecular weight of the surfactant increases. The viscosity also falls off as the shear rate increases. For example, in the range of about 61–65 wt. % solids, coal-water slurries with about 1.0 wt. % (basis wt. of solid fuel) of the Formula I surfactant have approximately the same viscosity. The di-nonyl phenol propylene oxide derivative, e.g., surfactant F in Table I, has a —O—$SO_3$—$Na^+$ terminal group. This preferred surfactant is superior to the other surfactants with respect to viscosity reduction.

The sedimentation rates for the coal-water slurries containing the surfactants described in Table I were measured by means of a vertical column 100 cm high×1 cm I.D. at room temperature. The height (cm) of supernatant fluid (clear water above the coal-water level) was measured with time. The results in Table III show that after 120 minutes, 93% of the solids in a slurry without one of the subject surfactants will settle out. In contrast, there was no settling of solids for those slurries containing 1.0 percent by weight (basis weight of solid fuel) of a surfactant listed in Table I.

TABLE I

SURFACTANT (FORMULA I)

| Surfactant | x | A | y | B—M | Approximate Molecular Wt. |
|---|---|---|---|---|---|
| A | 0 | $CH_2—CH_2—O$ | 5 | $CH_2—CH_2—OH$ | 484 |
| B | 0 | $CH_2—CH_2—O$ | 9 | $CH_2—CH_2—OH$ | 660 |
| C | 0 | $CH_2—CH_2—O$ | 14 | $CH_2—CH_2—OH$ | 880 |
| D | 0 | $CH_2—CH_2—O$ | 19 | $CH_2—CH_2—OH$ | 1100 |
| E | 1 | $CH_2—CH_2—O$ | 4 | $CH_2—CH_2—SO_3Na^+$ | 668 |
| F | 1 | $CH_3—\overset{\vert}{CH}—CH_2—O$ | 4 | $CH_3—\overset{\vert}{CH}—CH_2—O—SO_3Na^+$ | 743 |
| G | 0 | $CH_3—\overset{\vert}{CH}—CH_2—O$ | 5 | $CH_3—\overset{\vert}{CH}—CH_2—SO_3Na^+$ | 602 |

TABLE II

VISCOSITY OF COAL-WATER SLURRY

| Run No. | Surfactant | % Solids | Viscosity (poises) at the following shear rates ($sec^{-1}$) 5.1 $sec^{-1}$ | 10.2 $sec^{-1}$ | 170 $sec^{-1}$ | 340 $sec^{-1}$ | 510 $sec^{-1}$ |
|---|---|---|---|---|---|---|---|
| 1 | none | 63.23 | 22.5 poise | 12.5 poise | 3.8 poise | 2.7 poise | 2.15 poise |
| 2 | A | 62.05 | 12.50 poise | 7.50 poise | 2.31 poise | 1.95 poise | 1.75 poise |
| 3 | B | 64.38 | 5.00 poise | 3.75 poise | 1.20 poise | 0.90 poise | 0.90 poise |
| 4 | C | 64.33 | 7.00 poise | 4.75 poise | 1.98 poise | 1.62 poise | 1.30 poise |
| 5 | D | 64.17 | 2.50 poise | 2.00 poise | 1.14 poise | 0.84 poise | 0.60 poise |
| 6 | E | 62.28 | 5.00 poise | 4.0 poise | 1.71 poise | 1.42 poise | 1.20 poise |
| 7 | F | 61.92 | 2.0 poise | 2.0 poise | 0.72 poise | 0.57 poise | 0.54 poise |

TABLE III

SEDIMENTATION RATES - (% SOLIDS SETTLED)

| Run No. | Surfactant | 6 Min. | 18 Min. | 60 Min. | 90 Min. | 120 Min. | 240 Min. |
|---|---|---|---|---|---|---|---|
| 1 | none | 69% | 91% | 93% | 93% | 93% | 93% |
| 2 | A | 0% | 0% | 0% | 0% | 0% | 10% |
| 3 | B | 0% | 0% | 0% | 0% | 0% | 10% |
| 4 | C | 0% | 0% | 0% | 0% | 0% | 10% |
| 5 | D | 0% | 0% | 0% | 0% | 0% | 10% |
| 6 | E | 0% | 0% | 0% | 0% | 0% | 10% |
| 7 | F | 0% | 0% | 0% | 0% | 0% | 10% |

Other modifications and variations of the invention as hereinbefore set forth may be made without departing from the spirit and scope thereof, and therefore only such limitations should be imposed on the invention as are indicated in the appended claims.

We claim:

1. A pumpable slurry of solid carbonaceous fuel and water with reduced viscosity and sedimentation rate for use as feed to a partial oxidation gas generator for the production of raw synthesis gas, reducing gas, or fuel gas by reacting in said gas generator with a free-oxygen containing gas, said slurry comprising about 50 to 75 weight percent of high rank comminuted solid carbonaceous fuel having 5.0 weight percent or below of organically combined oxygen wherein said solid carbonaceous fuel is selected from the group consisting of anthracite coal, petroleum coke, coal liquefaction solid residue, asphaltic bitumen, and mixtures thereof; and about 0.001 to 0.100 parts by weight of a surfactant for each part by weight of said solid carbonaceous fuel, said surfactant having structural Formula I, as follows:

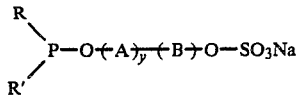

I wherein:

R and R′ are the same or different alkyl groups with 9 to 24 carbon atoms; P—O— is a phenolic moiety in which O is oxygen, A is a propoxy group and y equals 4 to 19; B is

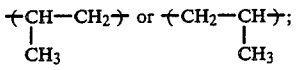

and the balance of said slurry is water.

2. A process for providing a solid carbonaceous fuel-water slurry for use as feedstock to a partial oxidation gas generator and reacting therein with a free-oxygen containing gas to produce synthesis gas, reducing gas, or fuel gas, said process comprising: wet grinding together (i) a solid carbonaceous fuel having less than 10.0 weight percent or organically combined oxygen and which is selected from the group consisting of anthracite coal, petroleum coke, coal liquefaction solid residue, asphaltic bitumen, and mixtures thereof; (ii) with water; and (iii) with about 0.001 to 0.100 parts by weight of a surfactant for each part by weight of said solid carbonaceous fuel, said surfactant having the following structural Formula I to produce a pumpable slurry having a solids content in the range of about 50 to 75 weight percent and having a reduced viscosity and increased resistance to sedimentation; wherein the comminuted solid carbonaceous fuel in said slurry has a particle size so that 99.9 wt. % of the material passes through an ASTM E11 Sieve Designation Standard 1.40 mm Alternative No. 14, 99.5 wt. of the material passes through an ASTM E11 425 μm Alternative No. 40, and at least 50 wt. % of the material passes through an ASTM E11 Sieve Designation Standard 45 μm Alternative No. 325; and wherein the structural Formula I for said surfactant as as follows:

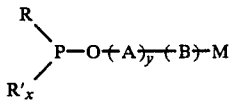

I wherein:

R and R′ are the same or different alkyl groups with 9 to 24 carbon atoms and x equals 0 or 1; P—O— is a phenolic moiety in which O is oxygen, A is an ethoxy or propoxy group and y equals 5 to 19 when x is 0 and 4 to 19 when x is 1; B is $-(CH_2-CH_2)-$ when A is ethoxy; or either

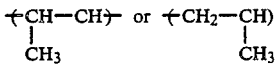

when A is propoxy; and M is the terminating moiety and is selected from the group consisting of —OH, $-SO_3Na^+$, and $-O-SO_3Na^+$; and the balance of said slurry is water.

* * * * *